US006332233B1

(12) United States Patent
Proulx

(10) Patent No.: US 6,332,233 B1
(45) Date of Patent: Dec. 25, 2001

(54) TOOTHBRUSH HANDLE

(76) Inventor: Genevieve C. Proulx, 1475 Waltham St., Gloucester, ON (CA), K1T 2T5

( * ) Notice: Subject to any disclaimer, the term of this patent is extended or adjusted under 35 U.S.C. 154(b) by 0 days.

(21) Appl. No.: 09/498,766

(22) Filed: Jan. 27, 2000

(51) Int. Cl.[7] ..... A46B 5/02; A46B 9/04

(52) U.S. Cl. ..... 15/167.1; 15/143.1; 16/430; 16/436; D4/104

(58) Field of Search ..... 15/143.1, 167.1; 16/430, 436; 81/489; D4/104, 138

(56) References Cited

U.S. PATENT DOCUMENTS

| | | | | |
|---|---|---|---|---|
| 1,657,450 | * | 1/1928 | Barnes | 15/167.1 |
| 2,094,240 | * | 9/1937 | Herrick et al. | 15/167.1 |
| 2,179,266 | * | 11/1939 | Lukenbill | 15/167.1 X |
| 2,263,885 | * | 11/1941 | McGauley | 15/143.1 |
| 2,267,670 | * | 12/1941 | Rosenwasser | 15/143.1 |
| 2,304,319 | * | 12/1942 | Saltzman | 15/167.1 |
| 3,067,446 | * | 12/1962 | McGauley | 15/143.1 |
| 4,739,536 | * | 4/1988 | Bandera et al. | 16/430 |
| 5,052,071 | * | 10/1991 | Halm | 15/167.1 |
| 5,339,482 | * | 8/1994 | Desimone et al. | 15/167.1 |
| 5,465,449 | * | 11/1995 | Lewkowicz | 15/143.1 X |

FOREIGN PATENT DOCUMENTS

| | | | | |
|---|---|---|---|---|
| 4229152 | * | 3/1994 | (DE) | 15/167.1 |
| 2522944 | * | 9/1983 | (FR) | 15/167.1 |

* cited by examiner

*Primary Examiner*—Mark Spisich

(57) ABSTRACT

A toothbrush handle with defined resilient finger tip engagable areas on each of respective opposite top and bottom faces of the handle.

2 Claims, 1 Drawing Sheet

TOOTHBRUSH HANDLE

FIELD OF INVENTION

This invention relates generally to dental hygiene and more particularly to a toothbrush handle that contributes to improved dental hygiene and a toothbrush incorporating such handle.

This application is closely related to applicant's corresponding Canadian application Serial No. 2,261,355 filed Feb. 10, 1999.

The term "dental hygiene", as contemplated herein, concerns healthy teeth and healthy peridontium the latter of which pertains to gums, periodontal ligament, alveolar bone and cementum.

In order to maintain healthy teeth and peridontium one needs to be diligent with their home care and practice good dental brushing habits. Extending tooth life is necessary because of increased life expectancy.

BACKGROUND OF INVENTION

People, with their natural teeth, normally brush regularly to maintain healthy teeth and gums. There are two principle aspects to consider one being the pressure applied to the teeth and the other the motion imparted to the brush during brushing. Both of these aspects are influenced by the toothbrush handle design.

One problem, common to many, is that too much pressure is applied to the teeth and gums during brushing. Too much pressure can cause, or contribute to, all kinds of dental problems such as recession, abrasion, loss of periodontal ligaments and/or loss of cementum and bone. Once the roots are exposed the teeth can become sensitive and the exposed roots are vulnerable to root decay. Gum recession also occurs.

Tooth brushes presently on the market are available with soft or ultra soft bristles, but this does little to alleviate the foregoing problems because the handle designs are conducive to applying heavy pressure during brushing. Specifically, the handles are long and because of their length, they are gripped in such a manner that results in high leverage to apply force to the bristle, i.e. head end of the brush.

Commonly the long handles are grasped by wrapping all of the fingers, on one hand, around the handle, i.e. a strong grip. With this grip heavy pressure can be applied without it being realized by the user how much pressure is actually being applied.

A long handle also extends beyond the finger grasped portion in a direction toward the wrist region. The projecting end of the handle engages in proximity of the wrist region or near the rear extremity of the hand and this engagement serves as a fulcrum for applying heavy pressure to the bristle end of the brush. As mentioned before, this heavy brushing pressure can be detrimental causing irreversible damage to the gums and/or teeth.

Turning to the other aspect it is difficult with existing toothbrush handle designs to impart a proper brushing motion during use. The motion employed normally is one or more of gum to tooth, modified bass and Steilman.

One purpose of brushing is to remove particulate material from between the teeth. The existing up and down brush motion employed, particularly along with high pressure applied during brushing, can be very damaging. The up and down motion particularly can cause gum recession and/or unknown to the brush user, force particulate material under the gum. The up and down motion normally each go from gum to tooth and tooth to gum, the latter of which is undesirable.

SUMMARY OF INVENTION

A principle object of the present invention is to provide a toothbrush handle that normally will be gripped in such a manner as to reduce the pressure one otherwise would apply to their teeth during brushing.

A further principle object of the present invention is provide a toothbrush handle that can be readily and comfortably gripped between the thumb and finger tips.

A further principle object is to provide a thumb and finger tip grip toothbrush handle that is relatively short in length thereby preventing the handle free end from engaging the hand at a position spaced a substantial distance from the fingers. Preferably the handle length corresponds approximately to the transverse width of the users four fingers.

A further principle object of the present invention is to provide a toothbrush handle with defined finger tip engagable areas on each of opposite top and bottom faces of the handle. These defined areas preferably comprise at least one defined area on each of such top and bottom faces of the handle and are positioned proximate the junction of the handle with the stem and wherein such defined area has thereon a resilient portion.

A further principle object of the present invention is to provide a mechanical toothbrush having a handle with a resilient finger engagable defined area, for at least the index finger, on each of the top and bottom faces of the handle.

In keeping with the foregoing, there is provided by the present invention a toothbrush handle having, on respective opposite top and bottom faces thereof, a designated area defining an index finger tip engaging area and wherein each such designated area includes a resilient portion that is finger pressure sensitive.

There is also provided in accordance with the present invention a toothbrush comprising a handle, a stem and a head with said head having bristles projecting therefrom and wherein said handle has finger pressure deformable defined areas on respective opposite top and bottom faces thereof defining finger tip engaging areas on each of said respective top and bottom faces.

LIST OF DRAWINGS

The invention is illustrated by way of example in the accompanying drawings wherein.

PREFERRED EMBODIMENT

Figure 1:
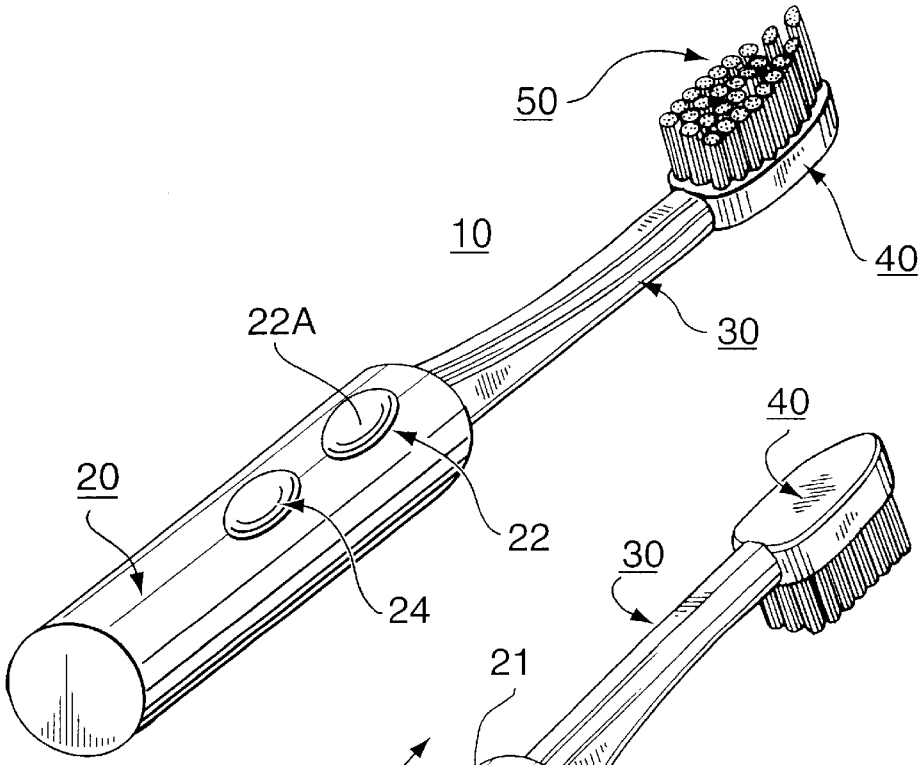
FIG. 1 is an oblique, bottom, view of a toothbrush having a handle of the present invention.
Figure 2:
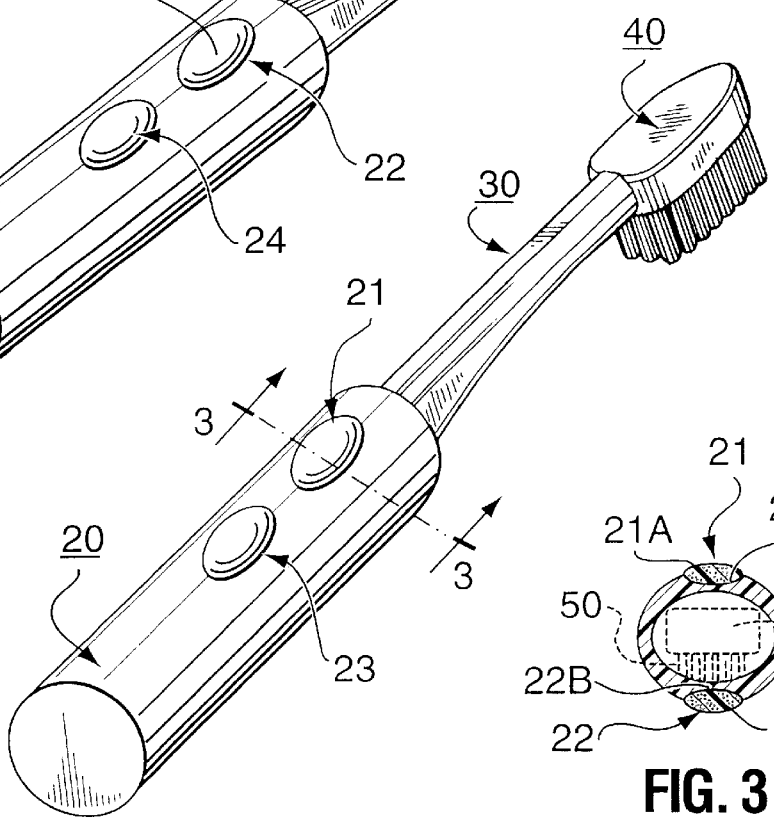
FIG. 2 is an oblique, top, view of the toothbrush of FIG. 1.

Referring to the drawing, there is illustrated a toothbrush 10 comprising a handle 20, a stem 30, a head 40 and bristles 50. The bristles 50 project outwardly from the head and both the head and the bristles are of conventional construction. For discussion purposes, the face of the handle corresponding to the bristle side of the brush is considered the bottom face (i.e. FIG. 1) and the other (i.e. FIG. 2) the top face.

The stem 30 is slender and conventionally, for the average toothbrush, is approximately 4 to 5 cm in length.

In the present invention, the handle 20 is approximately the same length as the stem.

The handle 20, in accordance with the present invention, has at least an index finger tip engagable area defined on each of the respective top and bottom faces of the handle. The toothbrush handle 20 is larger in cross-sectional outline than the stem 30 and may be circular, oval or rectangular. It is sufficiently large in cross-section so that the toothbrush can be firmly and comfortably gripped between the tip of one's thumb and the tip of at least the index finger. During brushing, the movement imparted by the fingers will cause the handle to oscillate about its longitudinal axis.

The number of fingers used by individuals to grip the handle will vary so as to be comfortable and provide sufficient force to render an effective cleaning. The length of the handle 20 is shorter than today's most used toothbrushes and in fact, the length preferably is no greater than the width of the users four side-by-side fingers. This prevents the user from getting any leverage for applying additional pressure to the teeth during brushing.

With finger tip feel, finger tip control, and finger tip positioning, one can readily carry out a cleaning motion of moving the brush in a direction from gum to tooth for both sides of the mouth, for the upper and low sets of teeth, as well for the mouth inside and outside of the teeth. The movement in part at least is one of oscillating the brush handle about its longitudinal axis.

Figure 3:
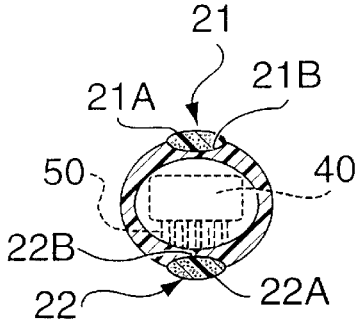
FIG. 3 is a sectional view along line 3—3 of FIG. 2.

As previously mentioned, the present invention is directed to at least an index finger engagable defined area on each of the top and bottom faces of the handle. Referring to the drawings, there is illustrated an index finger designated engagement areas 21 and 22 on the respective top and bottom faces of the handle. The bottom face is considered to be the bristle side of the brush (see FIG. 1) and the top face is that shown in FIG. 2. Preferably, the designated areas are oriented, relative to the bristles of the brush, as shown in FIG. 3. They could, however, if desired, be offset therefrom a certain amount in a direction circumferentially around the handle.

The defined areas 21 and 22 are on the handle at a location proximate the juncture of the stem and the handle and preferably opposite one another. If desired, they could be offset from one another in a direction longitudinally of the handle.

The defined area 21 illustrated comprises a resilient pad 21A and the defined area 22 comprises a resilient pad 22A. These pads could be placed on a flat surface of the respective faces of the handle 20 or in depressions in such surfaces as is illustrated in FIG. 3. Specifically, in reference to FIG. 3, the resilient pad 21A is located in a depression 21B in the handle while the resilient pad 22A is located in a depression designated 22B. These depressions may be circular, rectangular, triangular or of other shape in outline as may be desired.

The toothbrush handle 20 shown in the drawings also has designated areas 23 and 24 on the respective top and bottom faces of the handle. These areas are spaced from respective areas 21 and 22 in a direction toward the tip at free outer end of the handle and are for engagement by the tip of the finger next to the index finger. Each area preferably has a resilient pad or the equivalent and some means defining the respective areas. There may be, if desired, further defined areas for the remaining fingers on one's hand. The areas 21 and 23 on one face may be distinguished one from the other by color contrast and/or shape as may also areas 22 and 24 on the other face.

In the foregoing, the defined areas 22 and 24, on one face of the handle, have respective individual pads spaced from one another in a direction longitudinally of the handle and there may be additional defined areas for the third and fourth fingers. As an alternative to the individual pads, a continuous strip of material may be used and if desired seated in a channel that extends in a direction longitudinally of the handle. The continuous strip may have respective hard and soft areas alternating longitudinally of the strip with such soft areas defining resilient pads to be engaged by one's finger tips. Color contrasting and/or various outline shapes or other marking means such as ribs may be used to designate and distinguish the different areas and thus facilitate one locating the specific defined areas. As an alternative to the alternate soft and hard areas, the entire strip may be resiliently soft and the specific finger locations defined by indentations in the handle in the bottom of the channel or in the strip itself.

Figure 4:
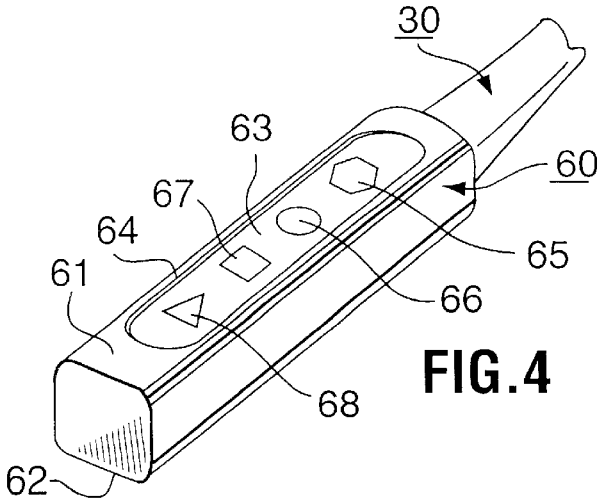
FIG. 4 is a perspective view of the handle portion of a toothbrush illustrating a modified designated finger tip engaging area.

Referring specifically to FIG. 4, there is illustrated a toothbrush handle 60 attached to a stem 30 of a toothbrush (bristles not shown). The handle 60 has a top face 61 (corresponding to the orientation shown in FIG. 2) and a bottom face 62 (corresponding to the orientation shown in FIG. 1).

The top and bottom faces have respective strips 63, 63A of material attached thereto and by way of example such strips may be located in a channel 64 in the respective top and bottom faces of the handle. Obviously the handle may merely have a smooth surface with the strips 63, 63A attached thereto by an adhesive.

The strips 63, 63A have a first designated area 65 which, during use, is engaged by the tip of the index finger, a second designated area 66 engaged by the tip of the next finger and third and fourth respective designated areas 67 and 68 for the remaining finger tips.

The areas 65, 66, 67 and 68 may be color contrasted and/or differently shaped areas as illustrated and/or represented by depressions or projections.

During use, the handle is grasped between the tip of the thumb and the tip of the index finger and if desired one or more of the remaining fingers. With this grasp, the brush is readily manipulated to effect a cleaning action by moving the brush from gum to tooth.

Figure 5:
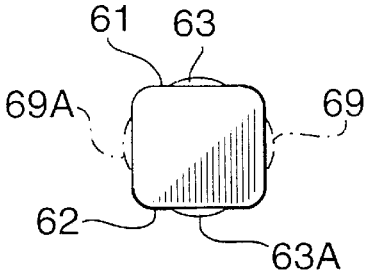
FIG. 5 is an end view of the handle shown in FIG. 4.

The strips 63, 63A, by way of example, may be a piece of self stick door weather stripping which is foam of the porous resilient type. The soft to touch finger tip areas are particularly advantageous and most particularly for teaching young children. The pads, when located in depressions also are advantageous as very little finger pressure is required to ensure a positive grip of the handle. The side faces of the handle also may have respective ones of strips 69, 69A (see FIG. 5) corresponding to the above-described strips 63, 63A.

The handle is preferably generally rectangular in cross-sectional outline and such outline is substantially greater than the cross-sectional outline of the stem.

I claim:

1. A toothbrush comprising a handle having respective top and bottom faces, a stem and a head, said head having bristles projecting therefrom, said handle having an index finger engaging defined area on each of said top and bottom faces, said defined areas being proximate the juncture of the handle and stem and a resilient member on said handle at each of said respective defined areas, depressions in said handle at positions spaced longitudinally therealong on each of said respective top and bottom faces, a resilient pad in each said depression providing finger tip engagable defined areas on the toothbrush handle and wherein said depressions are circular.

2. A toothbrush comprising:

(a) a brush head having bristles projecting therefrom;

(b) an elongate handle having a substantially rectangular cross-section, top and bottom faces extending along the length thereof and an elongate channel formed in each of said top and bottom faces;

(c) a resilient deformable strip secured to said handle and located in each of respective ones of said channels, each said strip including a plurality of substantially equally spaced indicia thereon for indicating to the user the proper placement of the fingers during use of the toothbrush; and (d) an elongate stem aligned with the handle and interconnecting said handle with the brush head, the length of said stem being approximately equal to that of the handle and wherein the cross-sectional outline of the handle is substantially greater than that of the stem.

* * * * *